US006082384A

United States Patent [19]

Cheng

[11] Patent Number: 6,082,384

[45] Date of Patent: Jul. 4, 2000

[54] HAND SUPPORT FOR WALKER FRAME

[76] Inventor: Yu Wen Cheng, 5F, No. 46, Shuang-Chuan Street, Pei Tou, Taipei, Taiwan

[21] Appl. No.: 09/071,754

[22] Filed: May 1, 1998

[51] Int. Cl.[7] ..... A45B 3/00

[52] U.S. Cl. ..... 135/66; 135/67

[58] Field of Search ..... 135/65, 66, 67, 135/72; 297/5–7; 482/66, 68, 69; 280/87.021, 87.041, 87.051

[56] References Cited

U.S. PATENT DOCUMENTS

| | | | |
|---|---|---|---|
| 3,085,258 | 4/1963 | Wolferts | 135/67 |
| 4,248,256 | 2/1981 | Thomas | 135/67 |
| 4,748,994 | 6/1988 | Schultz et al. | 135/67 |
| 5,005,599 | 4/1991 | Cunningham | 135/72 X |
| 5,133,377 | 7/1992 | Truxillo | 135/67 |
| 5,427,438 | 6/1995 | Fochs | 135/67 X |
| 5,445,174 | 8/1995 | Cunningham | 135/66 |

*Primary Examiner*—Lanna Mai

*Attorney, Agent, or Firm*—Pro-Techtor International Services

[57] ABSTRACT

A hand support for a walker frame with two rear frame bars, having a vertical bar, the upper end thereof being located lower than the upper side of the walker frame; a support bar with two ends that are hingedly connected to one of the rear frame bars and to the upper end of the vertical bar; and a stabilizing bar, mounted below the support bar parallel thereto, with two ends that are hingedly connected to one of the rear frame bars and to the upper end of the vertical bar. The support bar and the stabilizing bar are horizontally oriented, with the vertical bar resting on the ground, so as to aid a user to get up from a sitting position, or tilted upwards, with the vertical bar close to the rear frame bar of the walker frame to allow the user to walk unhindered using the walker frame.

4 Claims, 5 Drawing Sheets

HAND SUPPORT FOR WALKER FRAME

BACKGROUND OF THE INVENTION

1. Field of the Invention

The present invention relates to a hand support for a walker frame, particularly to a hand support for walker frames available on the market.

2. Description of Related Art

People with walking difficulties, like handicapped, reconvalescent or old persons, need the support of a walker frame. Usually walker frames support both hands of a user, helping her or him to walk. The hands of the user are put on hand rests, which are placed at about the height of the hip. When the user sits, the hand rests are at least as high as the breast of the user. Therefore getting up requires lifting the hands, grasping the hand rests and pulling the body up. However, if the arms of the user are weak, the user will be unable to get up on her or his own and need someone else's assistance. What is more, pulling oneself up to a conventional walker risks losing balance and fall with subsequent injuries.

To overcome this problem, walkers with an additional, lower hand frame on the rear side have been designed. For lifting up the body on such a walker frame, the user uses the additional hand frame as a support and thus gets up on her or his own with lower effort and reduced risk.

However, the additional hand frame leads to increased width of the walker frame, which therefore takes up more space and is less movable. This creates difficulties for transporting the walker frame and makes the walker frame inconvenient to use. Furthermore, an existing walker frame has to be given up for buying an entirely new one at considerable cost.

SUMMARY OF THE INVENTION

The main object of the present invention is to provide a hand support for a walker frame, which is folded up when not in use, so as to allow the user to walk unhindered and to minimize space required.

Another object of the present invention is to provide a hand support for a walker frame attachable to an existing, conventional walker frame, which is therefore usable without modifications.

The present invention can be more fully understood by reference to the following description and accompanying drawings.

DETAILED DESCRIPTION OF THE PREFERRED EMBODIMENT

Figure 1:
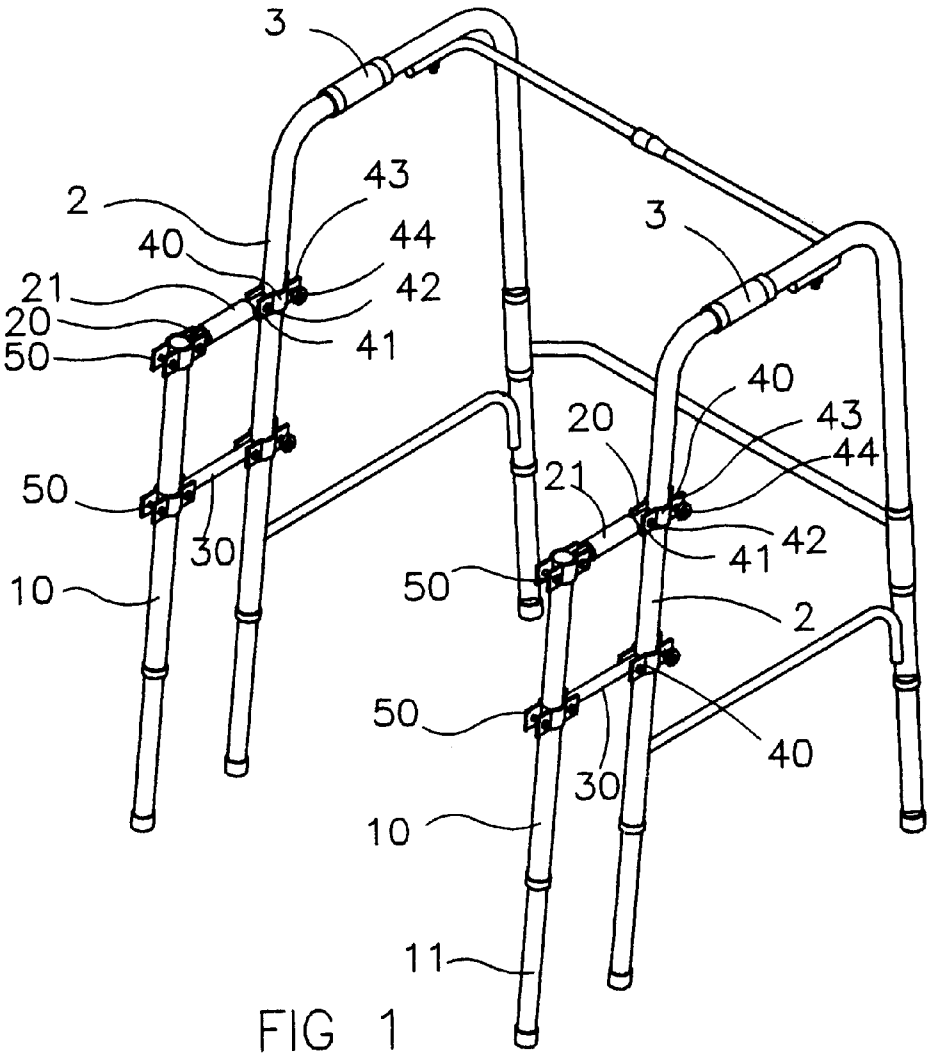
FIG. 1 is a perspective view of the hand support for a walker frame of the present invention, assembled with a conventional walker frame.

As shown in FIG. 1, the hand support for a walker frame of the present invention is mounted on a walker frame 1 on one or two sides thereof, helping a user in a sitting position to get up without assistance. The walker frame 1 has on each side a rear frame bar 2 and a hand rest 3. On each side of the walker frame, the hand support of the present invention comprises: a vertical bar 10, which is mounted on one of the rear bars 2 of the walker frame 1 and foldable, having an upper end and a lower end; an extension bar 11, inserted into the lower end of the vertical bar 10 and reaching from there parallel to the rear frame bar 2 to the ground for adjustably extending the length of the vertical bar 10; a support bar 20 with a connecting end and a far end, mounted between the upper end of the vertical bar 10 and the rear frame bar 2; and a stabilizing bar 30 with a connecting end and a far end, mounted below the support bar 20, parallel thereto, between the vertical bar 10 and the rear frame bar 2; two fixed joints 40, connecting the support bar 20 and the stabilizing bar 30 at the connecting ends thereof to the rear frame bar 2; and two moving joints 50, connecting the support bar 20 and the stabilizing bar 30 at the far ends thereof to the vertical bar 10.

Referring to FIG. 1, each of the fixed joints 40 has two brackets with extension plates 41, which rotatably surround the connecting end of the support bar 20 or the stabilizing bar 30 and are connected thereto by a bolt 42, passing through the connecting end of the support bar 20 or the stabilizing bar 30. Opposite to the extension plates 41, the two brackets of each fixed joint 40 have extension plates 43, which are connected by a bolt 44. Thereby the fixed joints 40 are fastened to the rear frame bar 2 of the walker frame 1, being dismountable from there, as required.

Figure 2:
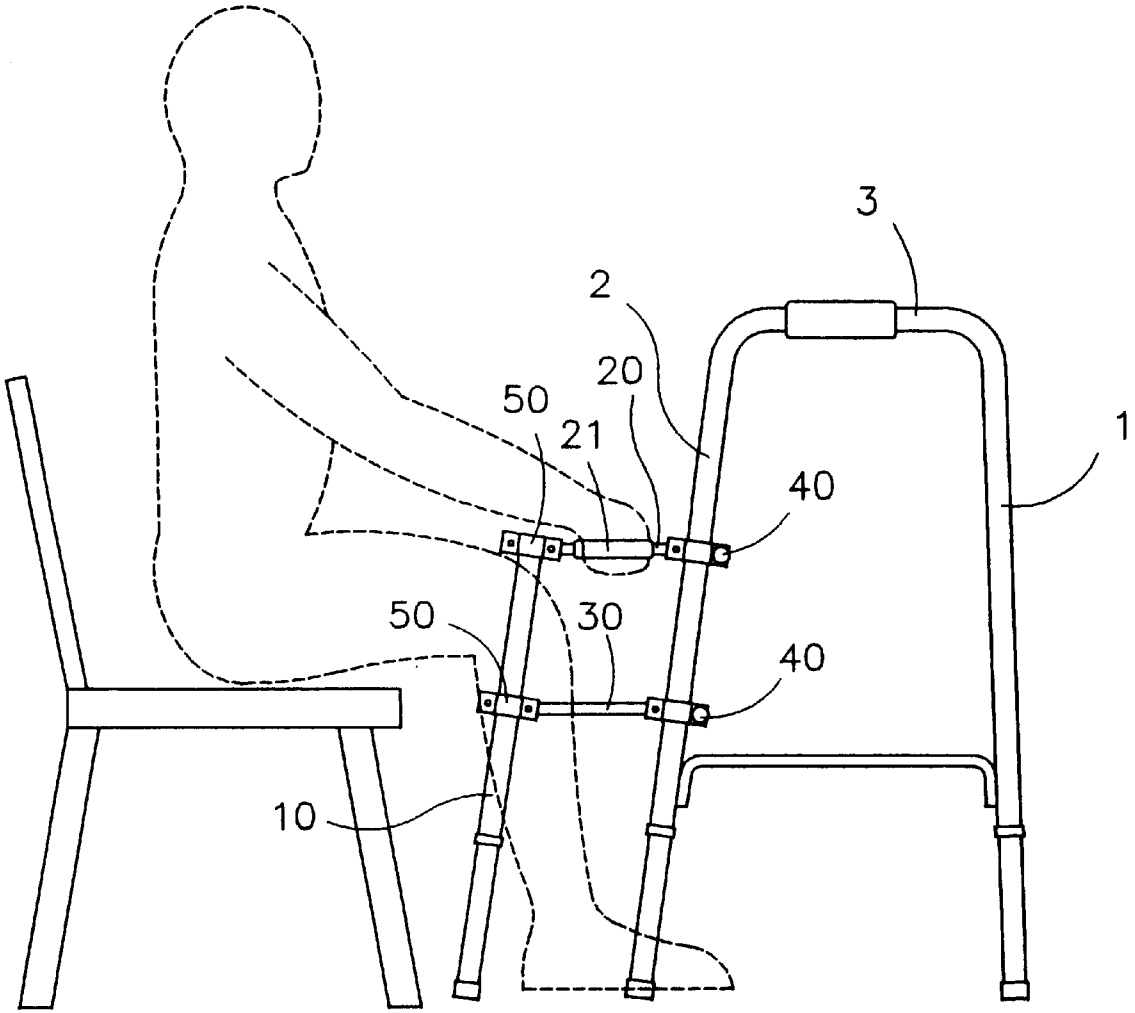
FIG. 2 is a schematic illustration of the use of the hand support for a walker frame of the present invention, with the user sitting.
Figure 3:
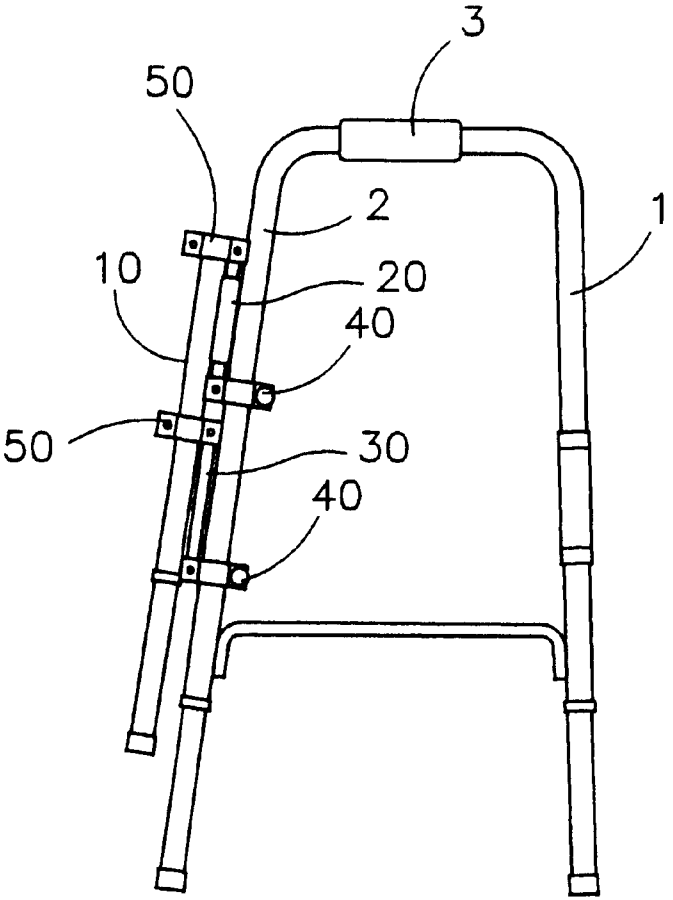
FIG. 3 is a side view of the hand support for a walker frame of the present invention, folded up for walking.

As shown in FIGS. 1–3, the support bar 20 and the stabilizing bar 30 are parallel to each other and have equal lengths. The fixed and movable joints 40, 50 form the four corners of a parallelogram. As show in FIG. 2, a handle 20 surrounds the support bar 20 to be grasped by the user for getting up. The support bar 20 is mounted on the rear frame bar 2 at a height that is about equal to the height of the upper end of the vertical bar 10. Thus, when the vertical bar 10, extended by the extension bar 11, rests on the ground, the support bar 20 is roughly horizontally oriented.

Figure 2A:
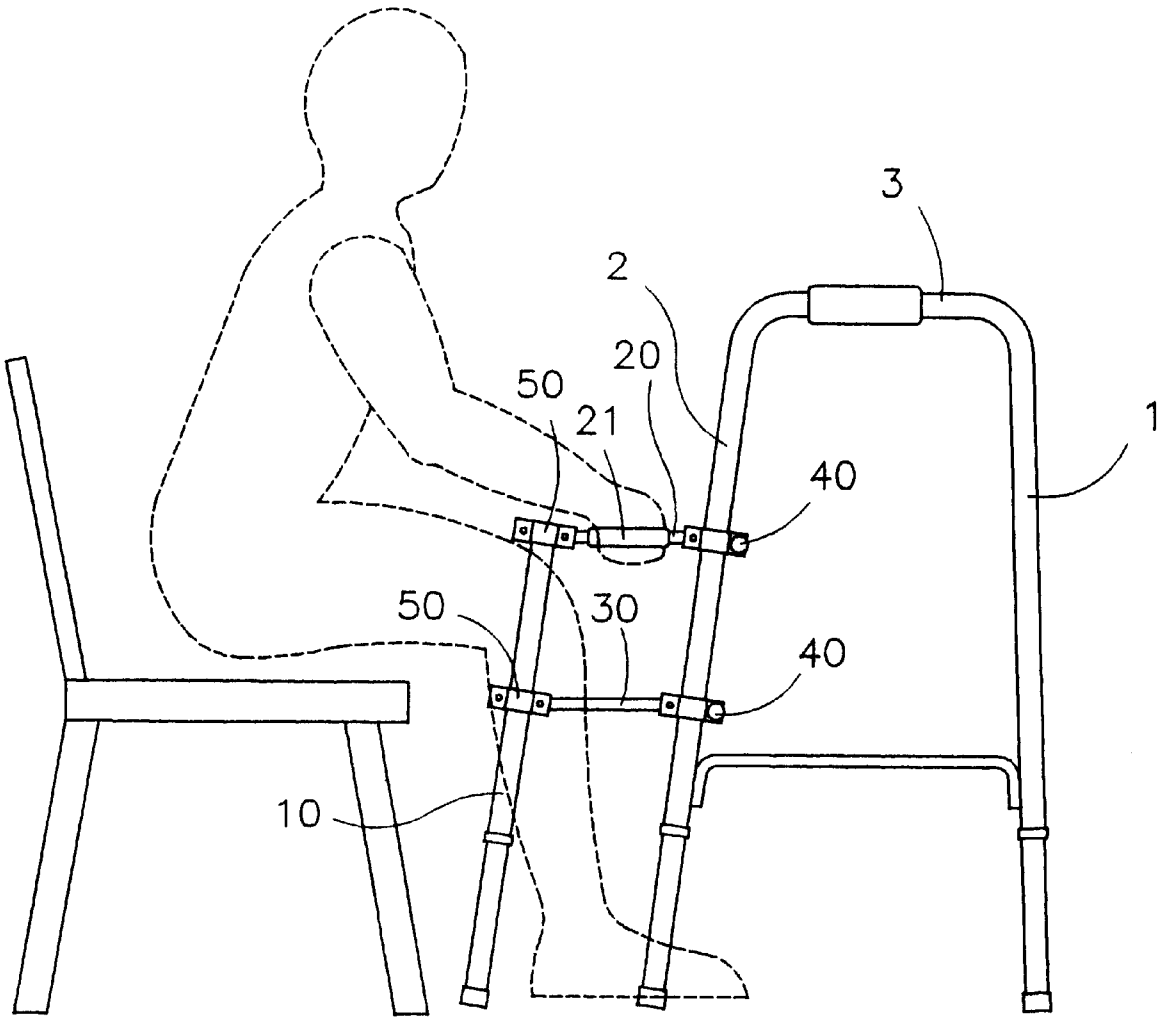
FIG. 2A is a schematic illustration of the use of the hand support for a walker frame of the present invention, with the user lifting the body up.
Figure 2B:
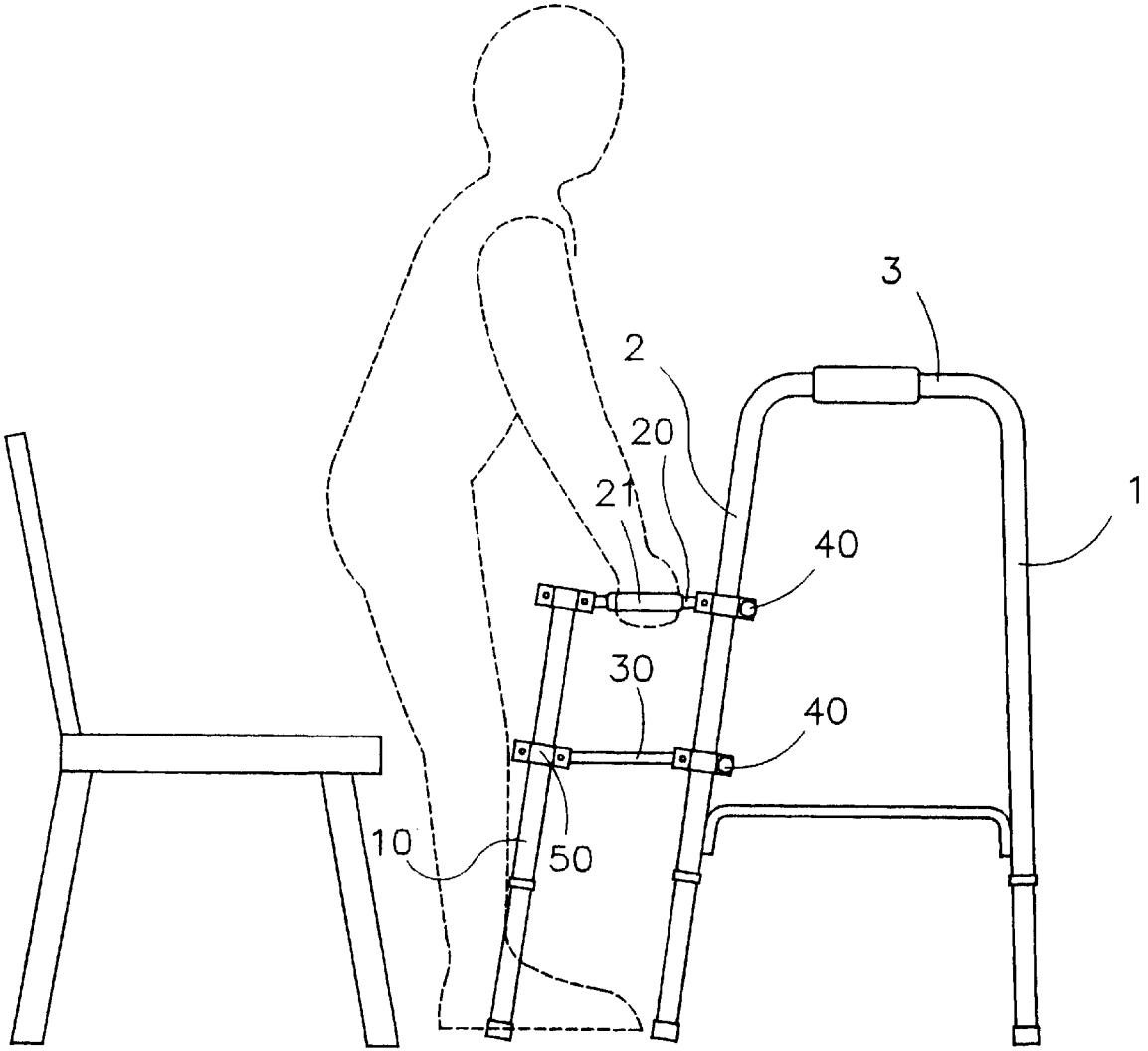
FIG. 2B is a schematic illustration of the use of the hand support for a walker frame of the present invention, with the user standing.

Referring to FIG. 2, the user is sitting behind the walker frame 1 with the hand support of the present invention, with the vertical bar 10 on the ground and the support bar 20 being horizontally oriented. Then the support bar is higher than the abdomen of the user. For getting up, as shown in FIGS. 2A and 2B, the user grasps with each hand the handle 21 around the support bar 20 and is able to pull herself or himself up with relative ease. Thus the user is able to get up without assistance.

Referring to FIG. 3, when the user is about to walk, she or he pull the vertical bar 10 up, tilting the support bar 20 and stabilizing bar 30 upwards and bringing the vertical bar 10 close to the rear frame bar 2 of the walker frame 1. Thus the user is able to walk unhindered by the hand support of the present invention. Since the rear frame bar 2 is slightly inclined forward, the vertical bar 10, support bar 20 and stabilizing bar 30 lean on the rear frame bar 2 and will not unfold.

Figure 4:
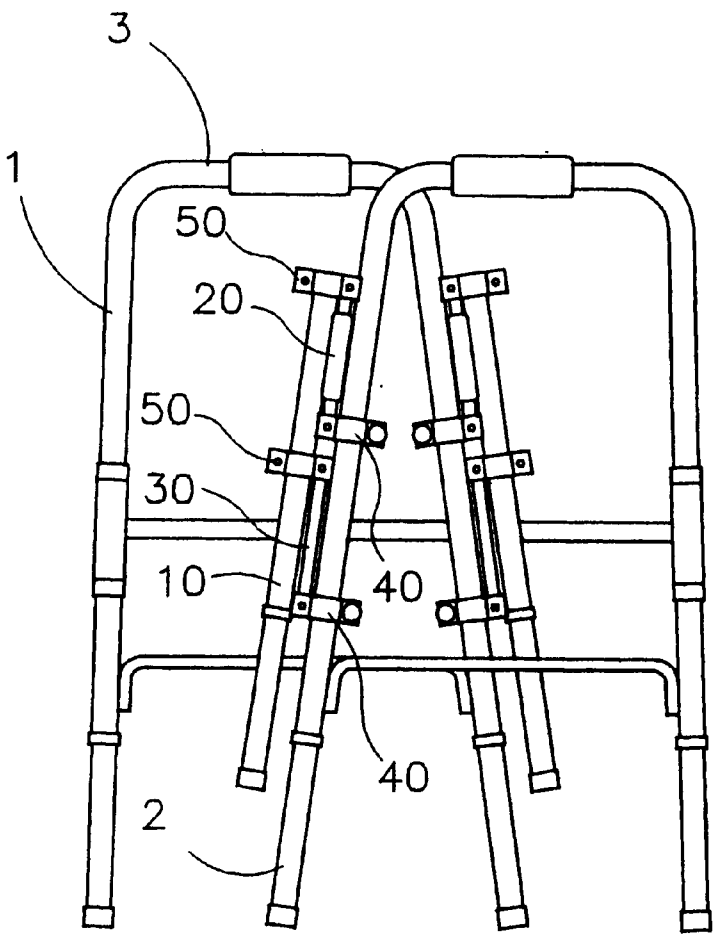
FIG. 4 is a side view of the hand support for a walker frame of the present invention, with the walker frame folded for storing.

Referring to FIG. 4, when the hand support of the present invention is unfolded against the walker frame 1, the lateral area thereof is almost unchanged, as compared to the walker frame 1 without hand support. This greatly simplifies transporting and storing of the walker frame 1 width the hand support of the present invention attached. Furthermore, by unscrewing the bolts 44, the fixed joints 40 are loosened from the rear frame bar 2, and the hand support of the present invention is removable from the walker frame 1.

While the invention has been described with reference to a preferred embodiment thereof, it is to be understood that modifications or variations may be easily made without departing from the scope and spirit of this invention which is defined by the appended claims.

I claim:

1. A hand support in combination with a walker frame with an upper side and two rear frame bars, comprising:

a vertical bar, having an upper end and a lower end, said upper end being located lower than said upper side of said walker frame;

a support bar, having a connecting end and a free end, said connecting end hingedly connected to one of said rear frame bars, said free end hingedly connected to an upper end of said vertical bar; and a stabilizing bar, having a connecting end an a free end, mounted below said support bar and being in parallel thereto, said connecting end hingedly connected to one of said rear frame bars, said free end hingedly connected to said vertical bar after "said vertical bar";

wherein said support bar and said stabilizing bar are horizontally oriented, with said lower end of said vertical bar resting on the ground, so as to aid a user to get up from a sitting position, or tilted upwards, with the vertical bar close to said rear frame bar of said walker frame to allow said user to walk unhindered using said walker frame.

2. A hand support in combination with a walker frame according to claim 1, wherein an extension bar extends from said lower end of said vertical bar to the ground, so as to allow for an adjustable height of said support bar.

3. A hand support in combination with a walker frame according to claim 1, wherein an support bar and said stabilizing bar have hinges on said connecting and free ends.

4. A hand support in combination with a walker frame according to claim 1, wherein an support bar is surrounded by a handle to be gripped by said user for getting up.

* * * * *